US007340211B2

(12) United States Patent
Kweon et al.

(10) Patent No.: US 7,340,211 B2
(45) Date of Patent: Mar. 4, 2008

(54) CLEANING APPARATUS AND IMAGE FORMING APPARATUS USING THE SAME

(75) Inventors: Dae-seob Kweon, Suwon-si (KR); Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 199 days.

(21) Appl. No.: 11/213,757

(22) Filed: Aug. 30, 2005

(65) Prior Publication Data

US 2006/0051143 A1 Mar. 9, 2006

(30) Foreign Application Priority Data

Sep. 6, 2004 (KR) ..... 10-2004-0070781

(51) Int. Cl.
*G03G 21/00* (2006.01)
*G03G 21/12* (2006.01)

(52) U.S. Cl. ..... 399/350; 399/360

(58) Field of Classification Search ..... 399/350, 399/358, 360

See application file for complete search history.

(56) References Cited

U.S. PATENT DOCUMENTS

| | | | | |
|---|---|---|---|---|
| 5,543,906 | A * | 8/1996 | Kanda | 399/358 |
| 7,016,639 | B2 * | 3/2006 | Park et al. | 399/350 |
| 2002/0048474 | A1 * | 4/2002 | Arimitsu et al. | 399/350 |
| 2004/0258441 | A1 * | 12/2004 | Park et al. | 399/358 |

FOREIGN PATENT DOCUMENTS

| | | |
|---|---|---|
| JP | 06-282208 | 10/1994 |
| JP | 11-024522 | 1/1999 |
| JP | 11-327394 | 11/1999 |
| JP | 2002-132107 | 5/2002 |
| JP | 2003-5598 | 1/2003 |
| JP | 2003-280476 | 10/2003 |
| KR | 2004-24813 A | 3/2004 |

OTHER PUBLICATIONS

Korean Office Action dated Feb. 16, 2006 of Korean Patent Application No. 10-2004-0070781.

* cited by examiner

*Primary Examiner*—Susan Lee
(74) *Attorney, Agent, or Firm*—Stanzione & Kim, LLP

(57) ABSTRACT

A cleaning apparatus and an image forming apparatus including the same. The cleaning apparatus includes: a developing unit to supply toner to an electrostatic latent image formed on a photosensitive body, a cleaning blade installed above the photosensitive body and the developing unit to contact a circumference of the photosensitive body along a lengthwise direction thereof with a predetermined force, to remove waste toner remaining on the photosensitive body, and having a surface along which the removed waste toner is transported, and a waste toner reservoir unit to store the waste toner transported along the surface after being removed by the cleaning blade, wherein the surface slopes upward at a predetermined angle with respect to a horizontal plane. The cleaning apparatus efficiently utilizes space in the image forming apparatus and can protect the photosensitive body and the developing unit from being deformed by external impact. The cleaning apparatus has a simple structure because it does not include an additional waste toner transporting device and can be manufactured at low costs.

23 Claims, 6 Drawing Sheets

CLEANING APPARATUS AND IMAGE FORMING APPARATUS USING THE SAME

CROSS-REFERENCE TO RELATED APPLICATIONS

This application claims priority from Korean Patent Application No. 2004-70781, filed on Sep. 6, 2004, in the Korean Intellectual Property Office, the disclosure of which is incorporated herein in its entirety by reference.

BACKGROUND OF THE INVENTION

1. Field of the Invention

The present general inventive concept relates to a cleaning apparatus usable with an image forming apparatus and an image forming apparatus including the same, and more particularly, to a cleaning apparatus to collect waste toner remaining on a photosensitive body after being transferred, and an image forming apparatus including the same.

2. Description of the Related Art

In general, an image forming apparatus, such as a laser printer or a copy machine, forms images while printing on sheets that are loaded in a paper feeding cassette, which is detachably installed in a main body of the image forming apparatus. An uppermost one of the sheets that are loaded in the paper feeding cassette is sequentially picked up by a pickup unit and moved to an image forming unit within the image forming apparatus.

FIG. 1 is a sectional view illustrating a conventional image forming apparatus, FIG. 2 is a sectional view illustrating a conventional cleaning apparatus of the conventional image forming apparatus of FIG. 1, FIG. 3 is a perspective view illustrating a cleaning blade of the conventional cleaning apparatus of FIG. 2, and FIG. 4 is a sectional view illustrating a waste toner reservoir unit of the conventional cleaning apparatus taken along line A-A of FIG. 2.

Referring to FIG. 1, a conventional image forming apparatus 1 is an electrophotographic image forming apparatus in which an electrostatic latent image formed on an external surface of a photosensitive body 15 is developed into a visible image by supplying toner, which is a developing agent, to the electrostatic latent image. The visible image is then transferred to a printing paper P and is then fused to obtain a desired printed image. In the conventional image forming apparatus 1, the printing paper P is moved from a lower portion to an upper portion thereof along a C-shaped path. The conventional image forming apparatus 1 includes a conventional cleaning apparatus 5, a transferring roller 25, a fixing unit 30, a laser scanning unit (LSU) 70, and a pick-up unit 50 including a pickup roller 55, which picks up the printing paper P The LSU 70 scans light that corresponds to image information to be printed onto the photosensitive body 15, which is described below, according to a computer signal to form the electrostatic latent image on the external surface of the photosensitive body 15.

Referring to FIG. 2, the conventional cleaning apparatus 5 includes a developing unit 10, the photosensitive body 15, and a waste toner reservoir unit 80.

The developing unit 10 is a cartridge that is detachably installed in a main frame 2 of the conventional image forming apparatus 1 (see FIG. 1). The developing unit 10 includes a developing unit housing 11, a developing roller 17, a supplying roller 19, an agitator 21, and a toner layer regulating unit 18. In addition, a toner storing portion 12 to store toner (i.e., the developing agent) is provided in the developing unit housing 11 of the developing unit 10. The developing unit 10 is replaced when the toner contained in the toner storing portion 12 is fully consumed.

The toner contained in the toner storing portion 12 is coated on an external surface of the developing roller 17, which supplies the toner to the photosensitive body 15. The developing roller 17, which is coated with toner in a solid powder form, develops the electrostatic latent image into a toner image by supplying the toner to the electrostatic latent image formed on the photosensitive body 15. A developing bias voltage is applied to the developing roller 17 to supply the toner to the photosensitive body 15. The supplying roller 19 supplies the toner in the toner storing portion 12 to the developing roller 17 while rotating in a predetermined direction. The agitator 21 agitates the toner in the toner storing portion 12 at a predetermined speed to prevent caking of the toner and moves the toner in the toner storing portion 12 closer to the supplying roller 19. One end of the toner layer regulating unit 18 is fixed to the developing unit housing 11. The other end of the toner layer regulating unit 18 contacts the developing roller 17, regulates a height of toner adhering to the external surface of the developing roller 17, and charges the toner to a predetermined polarity by creating friction.

Referring to FIGS. 1 and 2, the photosensitive body 15 rotates in a predetermined direction and is installed such that a portion of the external surface thereof is exposed. The photosensitive body 15 is charged to a predetermined potential by a charging roller 13, which is described below. As described above, the electrostatic latent image that corresponds to an image to be printed is formed on the external surface of the photosensitive body 15 according to the light emitted by the LSU 70. An exposed portion of the external surface of the photosensitive body 15 faces the transferring roller 25.

A charge bias voltage is applied to the charging roller 13. The charging roller 13 then charges the photosensitive body 15 to a predetermined potential.

Referring to FIGS. 2 and 4, the waste toner reservoir unit 80 is installed above and displaced from a center of the photosensitive body 15 and includes a housing 90, a cleaning blade 82, an auger 83, and a storing portion 86 (See FIG. 4).

The housing 90 is machined into a bent shape and forms a body of the waste toner reservoir unit 80. Referring to FIGS. 2 and 3, the cleaning blade 82 is installed such that one edge thereof is attached to the housing 90 and the other edge thereof is installed along a lengthwise direction of the photosensitive body 15 to contact and push a portion of the photosensitive body 15 with a predetermined force such that waste toner 81 remaining on the photosensitive body 15 can be removed therefrom. Referring to FIG. 4, the auger 83 is installed in the waste toner reservoir unit 80 to rotate in a predetermined direction to convey the waste toner 81 that is removed from the photosensitive body 15 into the storing portion 86 (See FIG. 4) along the lengthwise direction of the photosensitive body 15. The storing portion 86 (See FIG. 4) is located at one end of the waste toner reservoir unit 80 and receives the waste toner 81 that is conveyed by the auger 83.

Referring to FIG. 1, the transferring roller 25 is installed to face a circumference of the photosensitive body 15 and applies a transfer bias voltage having a polarity opposite to the toner image developed on the photosensitive body 15 such that the toner image can be transferred to the paper P. The toner image is transferred to the paper P by the electrostatic force exerted between the photosensitive body 15 and the transferring roller 25.

The fixing unit 30 includes a heating roller 31 and a pressing roller 33 installed to face the heating roller 31. The fixing unit 30 fixes the toner image to the paper P by applying heat and pressure to the toner image. The heating roller 31, which is a heat source for permanently fixing the toner image, is installed to face the pressing roller 33 along the axial direction. The pressing roller 33, which is installed to face the heating roller 31, fixes the toner image to the paper P by applying a high pressure to the paper R An uncurling portion 34 flattens the paper P, which has a curled shape due to heat that is applied while passing through the fixing unit 30. A paper discharging roller 35 discharges the paper P to which the toner image has been fixed out of the conventional image forming apparatus 1. The paper P that is discharged out of the conventional image forming apparatus 1 is laid on a printed paper cassette 3.

The conventional image forming apparatus 1 includes a paper feeding cassette 51 receiving blank sheets of paper P disposed under the main frame 2. The paper feeding cassette 51 includes a knock-up plate 53 on which sheets of paper P are loaded, a shaft 54, which is positioned above a front end of the knock-up plate 53 when the paper feeding cassette 51 is coupled to the image forming apparatus 1. The shaft 54 is rotated by driving power applied thereto by a driving motor (not shown) installed in the conventional image forming apparatus 1. A pick-up roller 55 is coupled with the shaft 54 and is rotated accordingly. An elastic member 57 elastically biases the knock-up plate 53 toward the pick-up roller 55 such that a leading edge of the paper P loaded on the knock-up plate 53 contacts and is moved by the pick-up roller 55. The pick-up roller 55 picks up the sheets of paper P loaded on the knock-up plate 53 one by one and moves the sheets of paper P toward a paper aligning unit 40. A frictional pad 60 is provided between the knock-up plate 53 and the paper aligning unit 40 to prevent more than one sheet of paper P picked up by the pick-up roller 55 from being fed forward such that only the uppermost sheet of paper P on the knock-up plate 53 can be transferred toward the paper aligning unit 40. The paper aligning unit 40 aligns the paper P to pass between the photosensitive body 15 and the transferring roller 25 such that the toner image can be transferred to a desired position on the paper P.

Hereinafter, operations of the conventional cleaning apparatus 5 and the conventional image forming apparatus 1 including the conventional cleaning apparatus 5 will be described with reference to FIGS. 1 through 4.

The photosensitive body 15 is uniformly charged to the predetermined potential by the charge bias voltage applied to the charging roller 13. The laser scanning unit (LSU) 70 radiates light corresponding to the image information according to the computer signal onto the photosensitive body 15. A portion of the photosensitive body 15 scanned by the LSU 70 is selectively discharged, thereby resulting in a drop in the predetermined potential. An electrostatic latent image is formed due to this variation in potential.

The toner in the toner storing portion 12 is agitated by the agitator 21 and is supplied to the developing roller 17 to which the developing bias voltage has been applied by the supplying roller 19. The thickness of toner adhering to the circumference of the developing roller 17 is made thin and uniform by the toner layer regulating unit 18. The toner adhering to the developing roller 17 is charged due to the friction between the developing roller 17 and the toner layer regulating unit 18. The toner on the circumference of the developing roller 17 adheres to the electrostatic latent image formed on the circumference of the photosensitive body 15 so that the electrostatic latent image on the photosensitive body 15 is developed into the toner image.

The paper P is drawn from the paper feeding cassette 51 by the pick-up roller 55. The paper P is transferred forth and appropriately aligned by the paper aligning unit 40 and passes between the photosensitive body 15 and the transferring roller 25. When the transfer bias voltage is applied to the transferring roller 25, the toner image developed on the photosensitive body 15 is transferred to the paper P.

After the toner image is transferred to the paper P, the waste toner 81 remaining on the circumference of the photosensitive body 15 is removed by the cleaning blade 82, and the removed waste toner 81 is conveyed along the lengthwise direction of the photosensitive body 15 into the storing portion 86 by the auger 83.

The fixing unit 30 fixes the toner image to the paper P by applying heat and pressure to the toner image that is transferred to the paper P. The uncurling portion 34 flattens the paper P, which is curled while passing through the fixing unit 30. The paper P that is transferred through the uncurling portion 34 is discharged out of the conventional image forming apparatus 1 and is laid on the printed paper cassette 3.

In the conventional image forming apparatus 1 in which the paper P is moved from the lower portion to the upper portion along a C-shaped path as described above, many spatial limitations arise due to this structure. In particular, in the conventional image forming apparatus 1 including the conventional cleaning apparatus 5, a space for storing the waste toner 81 removed from the photosensitive body 15 is an important consideration.

In the conventional cleaning apparatus 5 described above, the space for storing the waste toner 81 (i.e., the storing portion 86 ) has to be reserved on a side of the waste toner reservoir unit 80, and the waste toner 81 removed from the photosensitive body 15 has to be transported to the space for storing the waste toner 81 using a separate transporting device (i.e., the auger 83 ). Due to the needs for a separate space for storing the waste toner 81 and the waste toner transporting device, the structure of the conventional image forming apparatus 1 is complicated and manufacturing costs increase. Furthermore, the housing 90 of the waste toner reservoir unit 80 is relatively weak because it is machined using a bending technique. In addition, since the housing 90 of the waste toner reservoir unit 80 is installed above and displaced from the center of the photosensitive body 15, upper surfaces of the photosensitive body 15 and the developing unit 10 are exposed and are likely to be deformed by external impact.

SUMMARY OF THE INVENTION

The present general inventive concept provides a low-cost cleaning apparatus that does not require a separate space to store waste toner and a device to transport removed waste toner, and an image forming apparatus including the same.

The present general inventive concept also provides a cleaning apparatus which allows efficient space utilization in an image forming apparatus and can reduce an overall size of the image forming apparatus, and protects a developing unit from being deformed by external impact, and an image forming apparatus including the same.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing a cleaning apparatus comprising: a developing unit to supply toner to an electrostatic latent image formed on a photosensitive body, a cleaning blade installed above the photosensitive body and the developing unit to contact a circumference of the photosensitive body along a lengthwise direction thereof with a predetermined force, to remove waste toner remaining on the photosensitive body, and having a surface along which the removed waste toner is transported, and a waste toner reservoir unit to store the waste toner transported along the surface after being removed by the cleaning blade. The surface slopes upward at a predetermined angle with respect to a horizontal plane.

The surface of the cleaning blade may slope at an angle between 30 and 35°. In particular, the surface of the cleaning blade may slope at an angle of about 35°.

The waste toner reservoir unit may comprise: a bracket having a front side to which the cleaning blade is fixed and having a rear side connected to a storing portion of the waste toner reservoir unit to receive the waste toner transported along the surface, and a housing installed above the bracket and combined with the bracket to prevent overflow of the waste toner from the bracket and the housing.

The housing may comprise a waste toner overflow blocking member extending from a front edge thereof and having an end which contacts the circumference of the photosensitive body with a predetermined force to prevent overflow of the waste toner removed by the cleaning blade toward the photosensitive body.

The waste toner overflow blocking member may comprise a sealing film made of urethane.

The bracket may be manufactured using a drawing machining process to protect the photosensitive body and the developing unit from external impact. The bracket may be a metallic plate.

The foregoing and/or other aspects of the present general inventive concept are also achieved by providing an image forming apparatus including a photosensitive body to have an electrostatic latent image formed thereon, and a cleaning apparatus. The cleaning apparatus comprises a developing unit to supply toner to the electrostatic latent image formed on the photosensitive body, a cleaning blade installed above the photosensitive body and the developing unit to contact a circumference of the photosensitive body along a lengthwise direction of the photosensitive body with a predetermined force, to remove waste toner remaining on the photosensitive body, and having a surface along which the removed waste toner is transported, and a waste toner reservoir unit to store the waste toner transported along the surface after being removed by the cleaning blade. The surface slopes upward at a predetermined angle with respect to a horizontal plane.

The surface of the cleaning blade may slope at an angle between 30 and 35°. In particular, the surface of the cleaning blade may slope at an angle of about 35°.

The waste toner reservoir unit may comprise: a bracket having a front side to which the cleaning blade is fixed and having a rear side connected to a storing portion of the waste toner reservoir unit to receive the waste toner transported along the surface, and a housing installed above the bracket and combined with the bracket to prevent overflow of the waste toner from the bracket and the housing.

The housing may comprise a waste toner overflow blocking member extending from a front edge thereof and having an end which contacts the circumference of the photosensitive body with a predetermined force to prevent overflow of the waste toner removed by the cleaning blade toward the photosensitive body.

The bracket may be manufactured using a drawing machining process to protect the photosensitive body and the developing unit from external impact.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
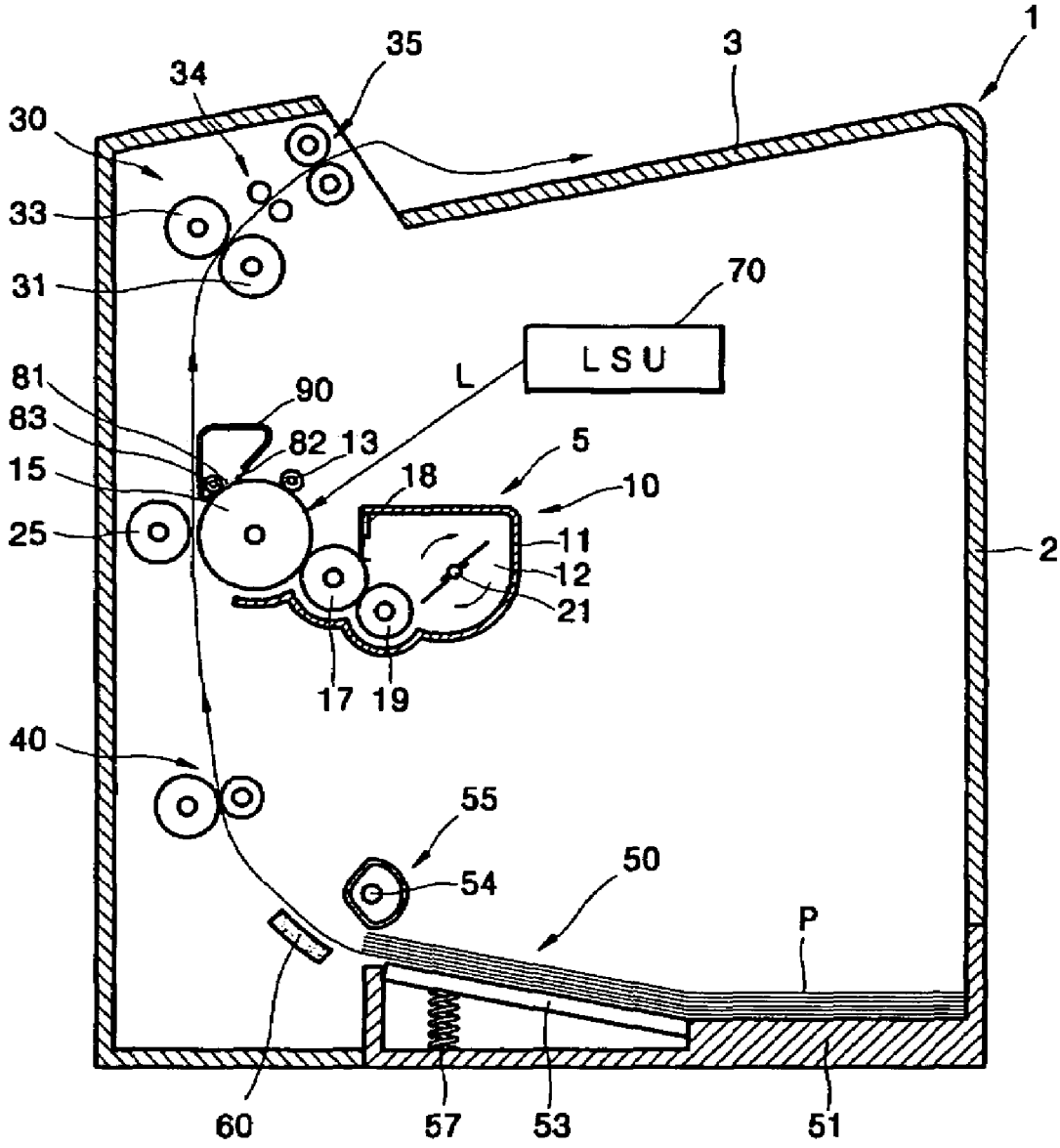
FIG. 1 (PRIOR ART)
FIG. 1 is a sectional view illustrating a conventional image forming apparatus.
Figure 2:
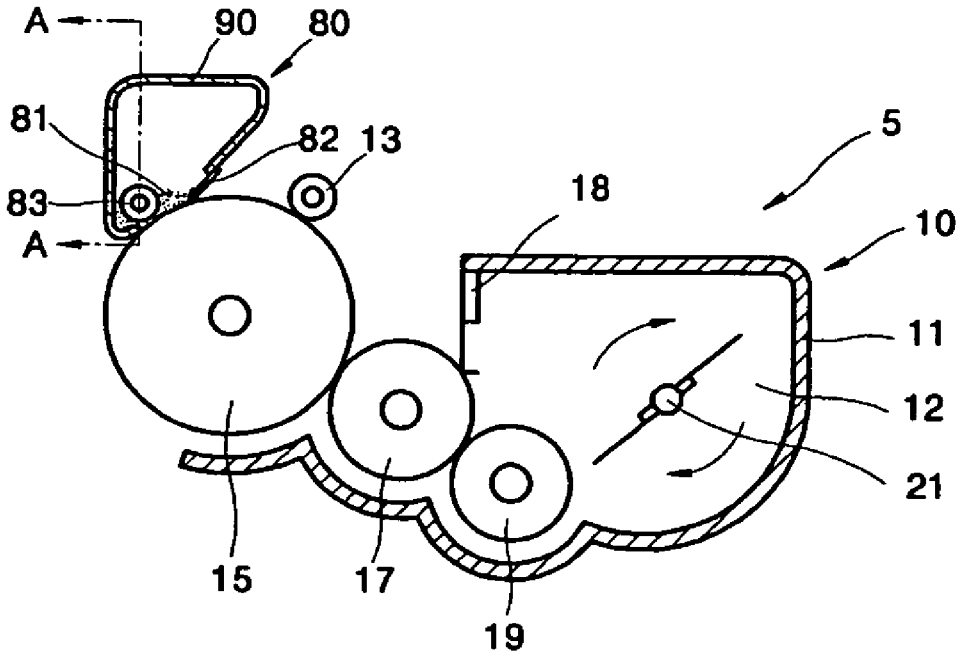
FIG. 2 (PRIOR ART)
FIG. 2 is a sectional view illustrating a conventional cleaning apparatus of the conventional image forming apparatus of FIG. 1.
Figure 3:
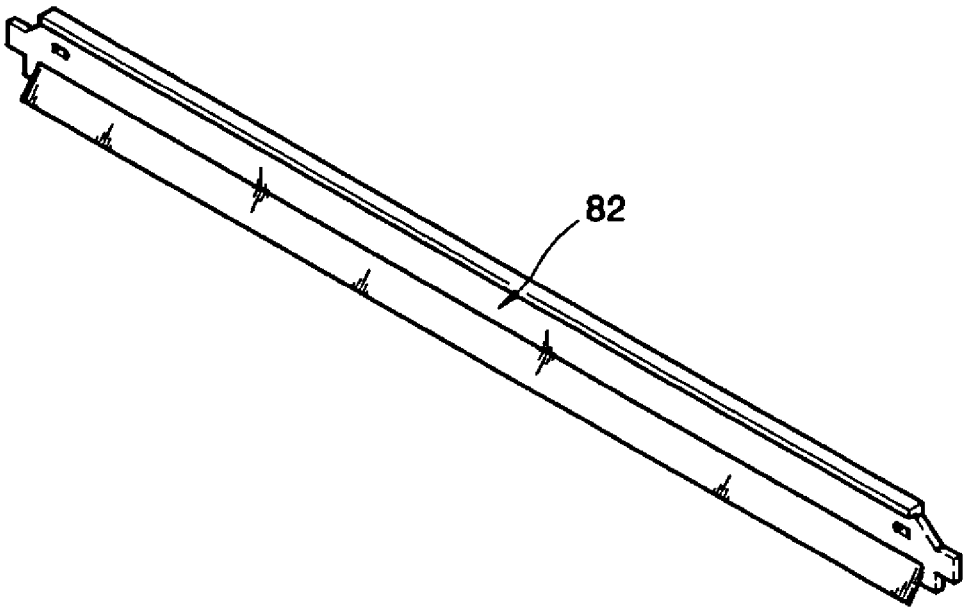
FIG. 3 (PRIOR ART)
FIG. 3 is a perspective view illustrating a cleaning blade of the conventional cleaning apparatus of FIG. 2.
Figure 4:
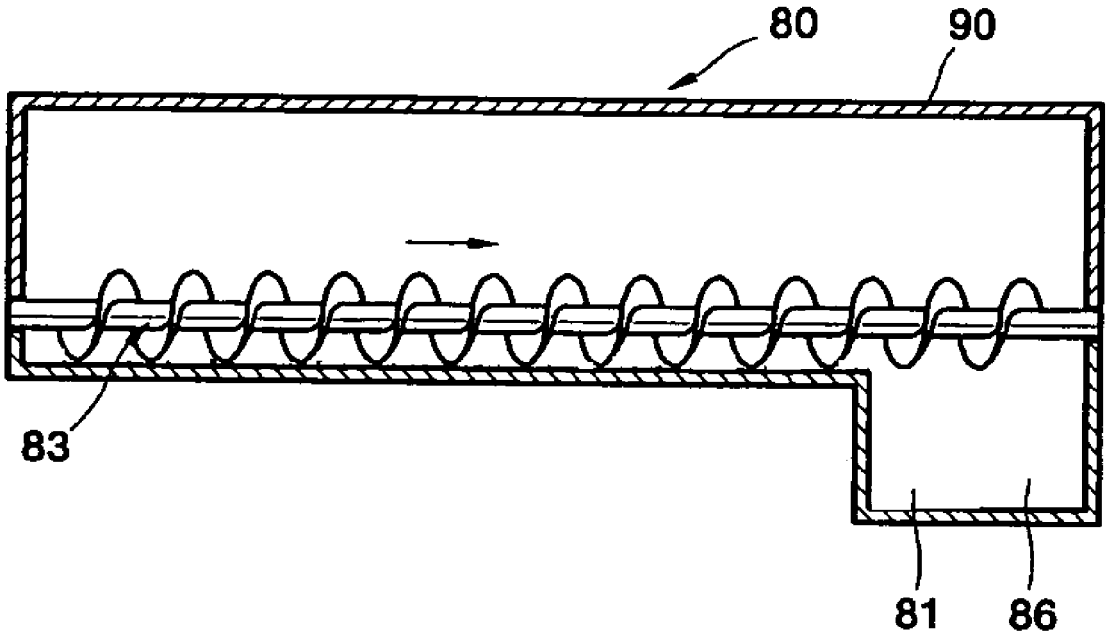
FIG. 4 (PRIOR ART)
FIG. 4 is a sectional view illustrating a waste toner reservoir unit of the conventional cleaning apparatus taken along line A-A of FIG. 2.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 5:
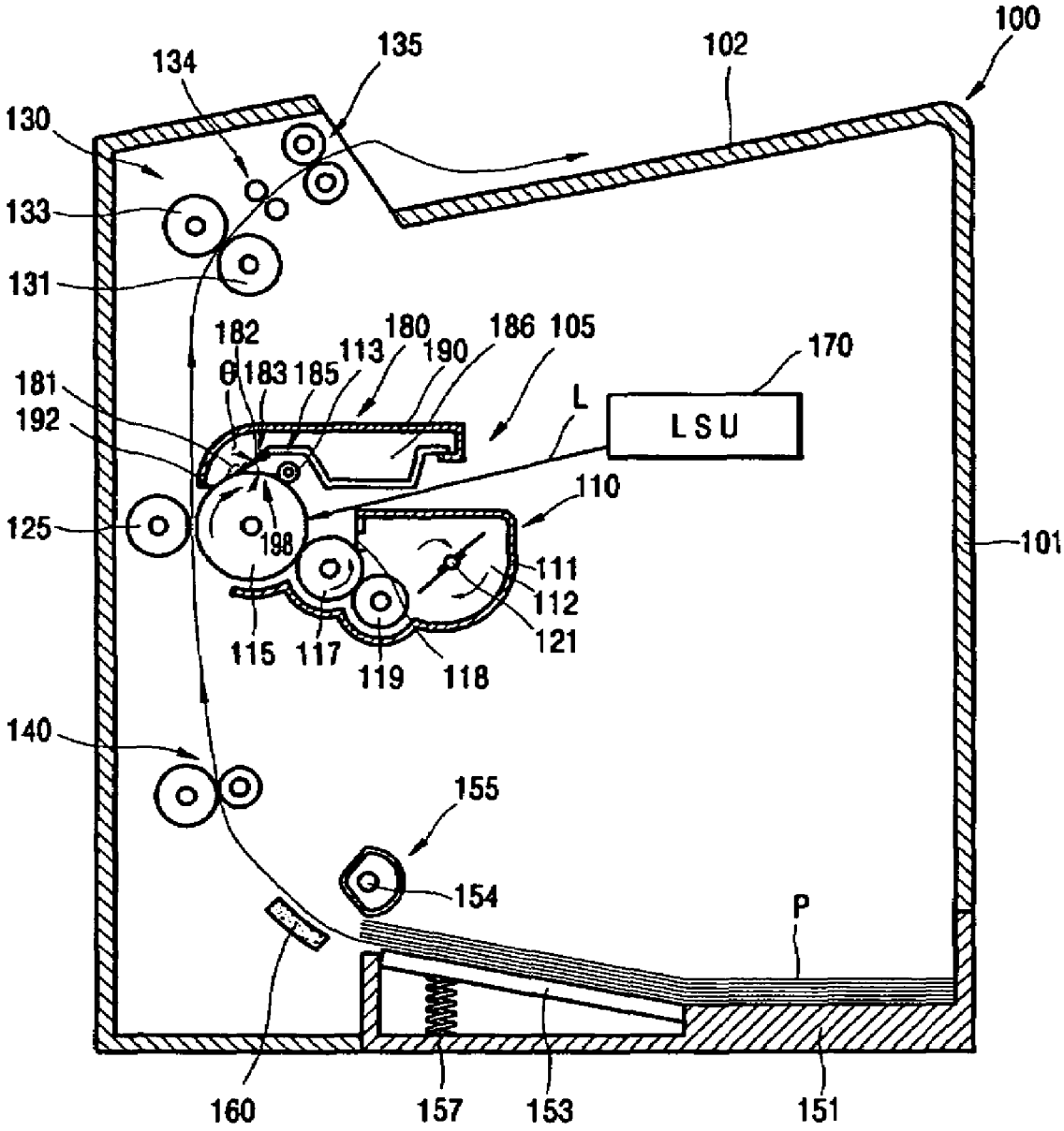
FIG. 5 is a sectional view illustrating an image forming apparatus according to an embodiment of the present general inventive concept.
Figure 6:
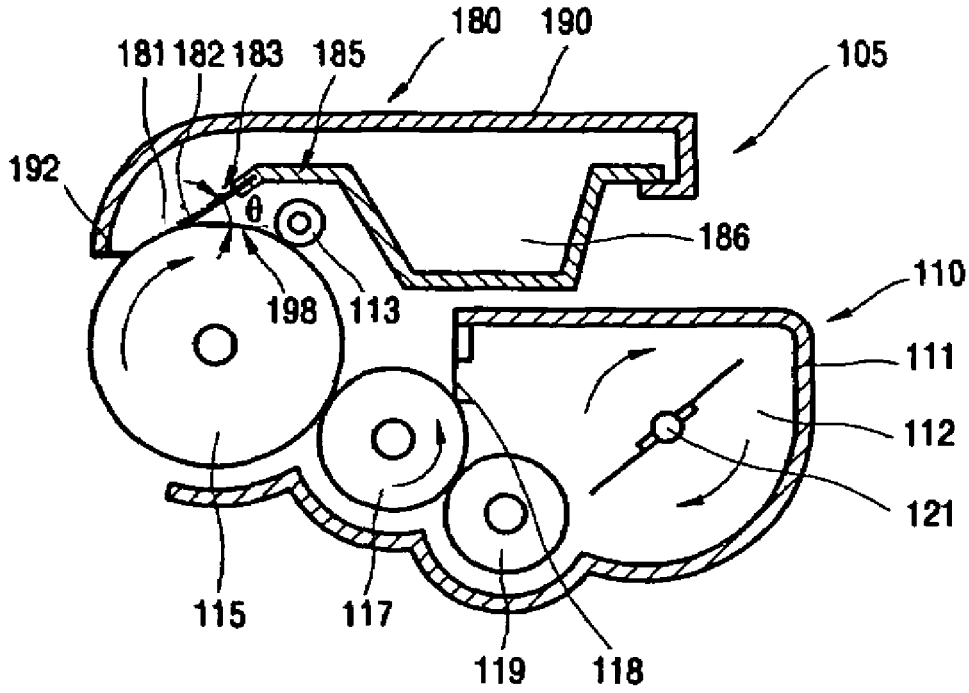
FIG. 6 is a sectional view illustrating a cleaning apparatus according to an embodiment of the present general inventive concept.
Figure 7A:
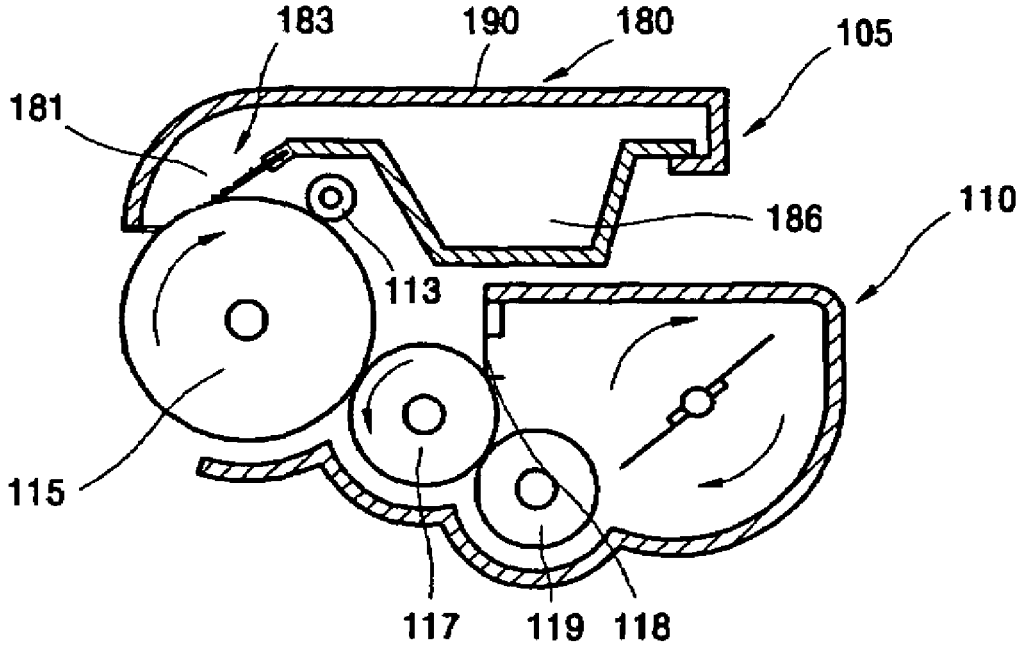
FIGS. 7A, 7B, and 7C are sectional views illustrating a process of transporting waste toner to a storing portion of the cleaning apparatus of FIG. 6.
Figure 7B:
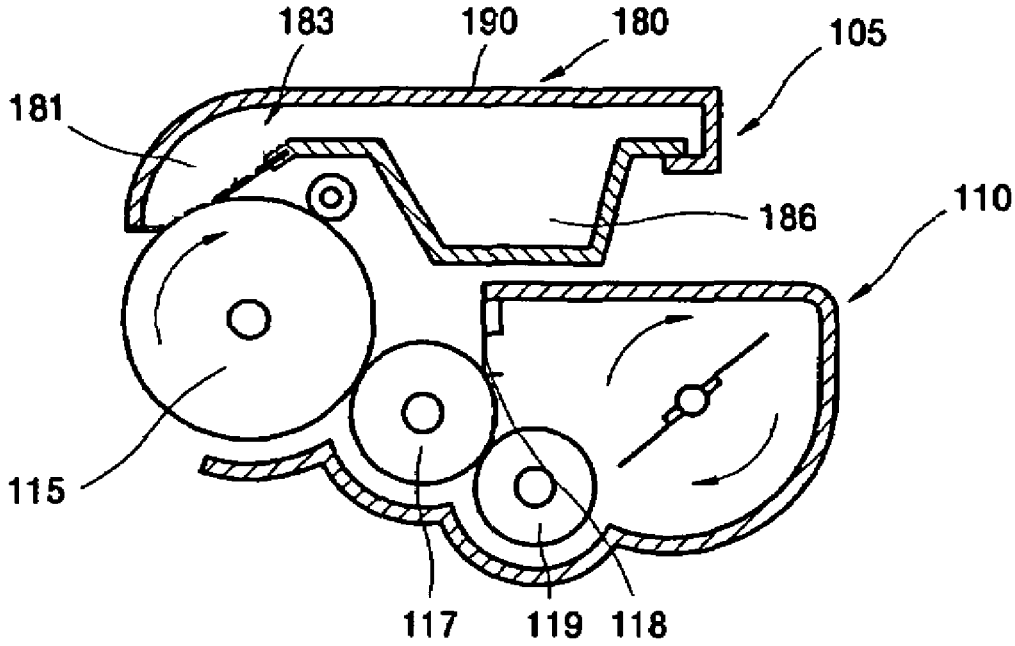
Figure 7C:
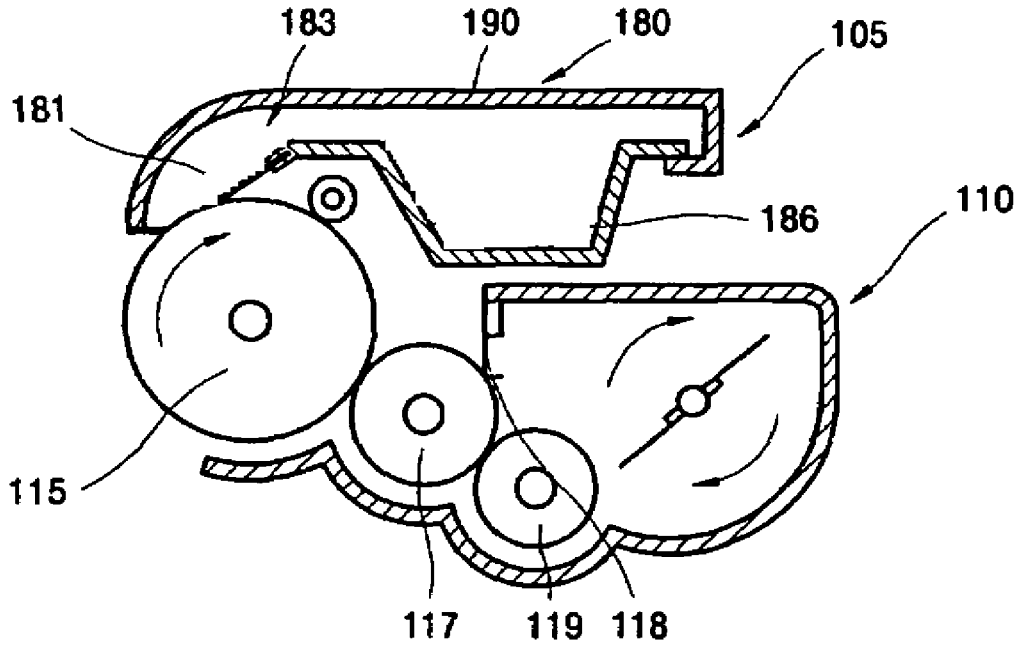

FIG. 5 is a sectional view illustrating an image forming apparatus according to an embodiment of the present general inventive concept. FIG. 6 is a sectional view illustrating a cleaning apparatus according to an embodiment of the present general inventive concept. FIGS. 7A, 7B, and 7C are sectional views illustrating a process of transporting waste toner to a storing portion of the cleaning apparatus of FIG. 6.

Referring to FIG. 5, an image forming apparatus 100 according to an embodiment of the present general inventive concept has a structure in which an electrostatic latent image that is formed on a circumference of a photosensitive body 115 by scanning a laser thereon is developed into a visible image by supplying toner, which is a developing agent, onto the electrostatic latent image. The visible image is then transferred to and fused onto paper P. In the image forming apparatus 100, the paper P is transferred from a lower portion to an upper portion along an approximate C-shaped path. The image forming apparatus 100 includes a cleaning apparatus 105, a transferring roller 125, a fixing unit 130, and a laser scanning unit (LSU) 170. In addition, the image forming apparatus 100 includes a pick-up roller 155 to pick up one or more sheets of paper P for printing one by one.

The LSU 170 scans the photosensitive body 115, which is described below, with the laser light according to a computer signal to form the electrostatic latent image on the circumference of the photosensitive body 115.

Referring to FIG. 6, the cleaning apparatus 105 includes a developing unit 110, the photosensitive body 115, and a waste toner reservoir unit 180.

Referring to FIGS. 5 and 6, the developing unit 110 is a cartridge that is installed to be detachable inside a main frame 101 of the image forming apparatus 100. The developing unit 110 includes a developing unit housing 111 that forms a body of the developing unit 110, a developing roller 117, a supplying roller 119, an agitator 121, and a toner layer regulating unit 118. In addition, a toner storing portion 112 to store toner used as the developing agent is provided in the developing unit housing 111 of the developing unit 110. The developing unit 110 can be replaced when the toner in the toner storing portion 112 is exhausted.

Referring to FIG. 6, the toner contained in the toner storing portion 112 is coated on a circumference of the developing roller 117, which supplies the toner to the photosensitive body 115. The developing roller 117 supplies the toner in a solid powder form to the electrostatic latent image formed on the photosensitive body 115 and develops the electrostatic latent image into a toner image. A developing bias voltage is applied to the developing roller 117 to supply the toner to the photosensitive body 115. A supplying roller 119 supplies the toner contained in the toner storing portion 112 to the developing roller 117 while rotating in a predetermined direction. The agitator 121 agitates the toner in the toner storing portion 112 at a predetermined speed to prevent caking of the toner and moves the toner to the supplying roller 119. One end of the toner layer regulating unit 118 is fixed to the developing unit housing 111 and the other end thereof contacts the developing roller 117. The toner layer regulating unit 118 regulates a height (i.e., a thickness) of the toner adhering to the circumference of the developing roller 117 and charges the toner to a predetermined polarity by creating friction.

Referring to FIGS. 5 and 6, the photosensitive body 115 is installed to be partially exposed and rotates in a predetermined direction. The photosensitive body 115 is charged to a predetermined potential by a charging roller 113. In addition, as described above, the electrostatic latent image that corresponds to an image to be printed is formed on the circumference of the photosensitive body 115 by the LSU 170 according to the computer signal received thereby. An exposed portion of the photosensitive body 115 faces the transferring roller 125.

Referring to FIG. 6, the charging roller 113 charges the photosensitive body 115 to the predetermined potential as a charge bias voltage is applied thereto. A corona discharger may be used instead of the charging roller 113 to charge the photosensitive body 115 to the predetermined potential.

A cleaning blade 182 is installed above the photosensitive body 115 and the developing unit 110. The cleaning blade 182 contacts the circumference of the photosensitive body 115 along a lengthwise direction of the photosensitive body 115 with a predetermined force and removes a waste toner 181 remaining on the photosensitive body 115. One end of the cleaning blade 182 is fixed to the waste toner reservoir unit 180 described below. The other end of the cleaning blade 182 may be installed to contact the circumference of the photosensitive body 115 with a predetermined pressure that corresponds to the predetermined force. An upper surface of the cleaning blade 182 is a surface 183, which removes the waste toner 181 from the photosensitive body 115. When a predetermined amount of the waste toner 181 that is removed from the photosensitive body 115 collects on the cleaning blade 182, the waste toner 181 is transported from the end of the cleaning blade 182 that contacts the photosensitive body 115 to a storing portion 186 at an opposite side of the waste toner reservoir unit 180 along the surface 183 (i.e., the upper surface of the cleaning blade 182). The surface 183 may slope at a predetermined angle θ with respect to a horizontal plane 198 that contacts a top of the photosensitive body 115 to enable the waste toner 181 to be transported along the surface 183. The predetermined angle θ of sloping of the cleaning blade 182 is determined through experiments by considering internal space utilization efficiency in the image forming apparatus 100 and an ability to transport the removed waste toner 181 without using an additional transporting device. The data obtained through experiments are as follows.

| Angle of sloping of cleaning blade (θ) | 20° | 30° | 35° | 40° | 50° |
|---|---|---|---|---|---|
| Installation space (relative ratio with respect to the installation space at 35°) | 1.8 | 1.3 | 1.0 | 0.9 | 0.85 |
| Waste toner overflowing point (when 5,000 sheets of paper and 150 g of toner are used) | None | None | None | 1620th paper | 1050th paper |

As indicated by the table above, when the cleaning blade 182 slopes at a large sloping angle, it is advantageous in view of the internal space utilization efficiency of the image forming apparatus 100, especially, regarding the internal installation space of the waste toner reservoir unit 180. However, the waste toner 181 overflows because the waste toner 181 cannot be transported to the storing portion 186. When the waste toner 181 overflows, the paper P and the devices installed in the image forming apparatus 100 can be contaminated by the waste toner 181. Furthermore, the overflowed waste toner 181 may contaminate the fixing unit 130, thereby disabling temperature control of the fixing unit 130. As a result, the paper P adheres to the fixing unit 130 and can get jammed, thereby causing a malfunction in the image forming apparatus 100. On the other hand, when the cleaning blade 182 is installed at a small sloping angle, the waste toner 181 can be easily transported to the storing portion 186. However, the internal installation space occupied by the waste toner reservoir unit 180 in the image forming apparatus 100 increases.

Therefore, by considering the ability to transport the waste toner 181 and the internal installation space of the waste toner reservoir unit 180, the predetermined angle θ at which the surface 183 slopes may be determined. For example, the predetermined angle θ may be set between 30° and 35°. In particular, the predetermined angle θ may be set to about 35°. When the surface 183 slopes in the above range of angles with respect to the horizontal plane 198, the waste toner 181 removed from the photosensitive body 115 collects on the cleaning blade 182 until the predetermined amount is collected and is then spontaneously transported to the storing portion 186 along the surface 183. In other words, the cleaning apparatus 105 with the cleaning blade 182 installed to slope at the predetermined angle θ described above does not require an additional device to transport the waste toner 181 removed from the photosensitive body 115 to the storing portion 186.

The waste toner reservoir unit 180 includes the cleaning blade 182 to remove the waste toner 181 remaining on the photosensitive body 115, as described above, a bracket 185 to receive the waste toner 181, and a housing 190 to cover the bracket 185.

The bracket 185 is located above the photosensitive body 115 and the developing unit 110. The cleaning blade 182 is fixed to a front side of the bracket 185. The storing portion 186, which actually receives the waste toner 181 that is transported along the surface 183, is located in a rear portion of the bracket 185. As a size of the image forming apparatus 100 decreases, a size of the developing unit 110 also decreases. However, as the size of the developing unit 110 decreases, the developing unit 110 is more likely to be deformed by external impacts. Therefore, the bracket 185 may be positioned above the photosensitive body 115 and the developing unit 110 to protect the developing unit 110 from external impacts. Additionally, the bracket 185 may be manufactured using a drawing machining process. Drawing machining is a mechanical molding process used to form seamless containers in any shape using malleability of a source material. For example, the bracket 185 may be formed of a metallic plate.

The housing 190 is arranged above the bracket 185 and is combined with the bracket 185 to prevent overflowing of the waste toner 181. A waste toner overflow blocking member 192 is installed on the housing 190. One end of the waste toner overflow blocking member 192 is fixed to a front edge of the housing 190, and the other end thereof contacts the circumference of the photosensitive body 115 with a predetermined force to prevent the waste toner 181 removed by the cleaning blade 182 from overflowing outside along the circumference of the photosensitive body 115. The waste toner overflow blocking member 192 may be formed using a sealing member. For example, the sealing member may be made of urethane.

The transferring roller 125 is installed to face the circumference of the photosensitive body 115. A transfer bias voltage having a polarity opposite to the polarity of the toner image is applied to the transferring roller 125 such that the toner image developed on the photosensitive body 115 can be transferred to the paper P The toner image is then transferred to the paper P by electrostatic force exerted between the photosensitive body 115 and the transferring roller 125. The toner image developed on the circumference of the photosensitive body 115 is then transferred to the paper P that passes between the photosensitive body 115 and the transferring roller 125 by the electrostatic force exerted due to the contact between the photosensitive body 115 and the transferring roller 125.

The fixing unit 130 includes a heating roller 131 and a pressing roller 133 disposed to face the heating roller 131. The fixing unit 130 fixes the transferred toner image to the paper P by applying heat and pressure to the toner image transferred to the paper P. The heating roller 131 is a heat source installed to face the pressing roller 133 along an axial direction thereof to permanently fix the toner image to the paper P. The pressing roller 133 is installed to face the heating roller 131 and applies a high pressure to the paper P to fix the toner image to the paper P. An uncurling portion 134 flattens the paper P, which is curled by the applied heat while passing through the fixing unit 130. A paper discharging roller 135 discharges the paper P on which the toner image has been completely fixed out of the image forming apparatus 100. The paper P that is discharged out of the image forming apparatus 100 is laid on a printed paper cassette 102.

The image forming apparatus 100 further includes a paper feeding cassette 151 to receive blank sheets of paper P under the main frame 101. The paper feeding cassette 151 includes a knock-up plate 153 on which the sheets of paper P are loaded, a shaft 154, which is positioned above a front end of the knock-up plate 153 when the paper feeding cassette 151 is coupled to the image forming apparatus 100, that is rotated by a driving power applied to the shaft 154 by a driving motor (not shown) installed in the image forming apparatus 100. A pick-up roller 155 is coupled with the shaft 154 and is rotated accordingly. An elastic member 157 elastically biases the knock-up plate 153 toward the pick-up roller 155 such that a leading edge of the paper P loaded on the knock-up plate 153 contacts and is transferred by the pick-up roller 155. The pick-up roller 155 picks up the sheets of paper P loaded on the knock-up plate 153 one by one and moves the sheets of paper P toward a paper aligning unit 140. A frictional pad 160 is provided between the knock-up plate 153 and the aligning unit 140 to prevent more than one sheet of paper P picked up by the pick-up roller 155 from being transferred forward such that only an uppermost sheet of paper P on the knock-up plate 153 can be transferred toward the paper aligning unit 140. The paper aligning unit 140 aligns the paper P to pass between the photosensitive body 115 and the transferring roller 125 such that the toner image can be transferred to a desired position on the paper P.

Hereinafter, operations of the cleaning apparatus 105 and the image forming apparatus 100 including the same according to an embodiment of the present general inventive concept will be described with reference to FIGS. 5 and 6.

The photosensitive body 115 is uniformly charged to the predetermined potential by the charge bias voltage applied to the charging roller 113. The LSU 170 radiates light that corresponds to image information onto the photosensitive body 115 according to the computer signal received by the LSU 170. A portion of the photosensitive body 115 scanned by the LSU 170 is selectively discharged, thereby resulting in a drop in the predetermined potential. The electrostatic latent image is formed due to this variation in potential.

The toner in the toner storing portion 112 is agitated by the agitator 121 and is supplied to the developing roller 117 to which the developing bias voltage has been applied by the supplying roller 119. The thickness of the toner adhering to the circumference of the developing roller 117 is made thin and uniform by the toner layer regulating unit 118. The toner adhering to the developing roller 117 is charged due to the friction between the developing roller 117 and the toner layer regulating unit 118. The toner on the circumference of the developing roller 117 adheres to the electrostatic latent image formed on the circumference of the photosensitive body 115 so that the electrostatic latent image on the photosensitive body 115 is developed into the toner image.

The paper P is drawn from the paper feeding cassette 151 by the pick-up roller 155. The paper P is moved forth and is appropriately aligned by the paper aligning unit 140 and is transferred between the photosensitive body 115 and the transferring roller 125. When the transfer bias voltage is applied to the transferring roller 125, the toner image developed on the photosensitive body 115 is transferred to the paper P.

The waste toner 181 remaining on the circumference of the photosensitive body 115 after the toner image has been transferred to the paper P is removed by the cleaning blade 182. The removed waste toner 181 collects on the cleaning blade 182. When the predetermined amount of the waste toner 181 is collected on the cleaning blade 182, the waste toner 181 is moved toward the storing portion 186 along the bracket 185, which may be manufactured using a drawing machining process, along the surface 183 on the cleaning blade 182 in synchronization with rotation of the photosensitive body 115. Here, no additional transporting device is required to transport the removed waste toner 181 to the storing portion 186. The process of transporting the waste toner 181 is illustrated in FIGS. 7A, 7B, and 7C. FIG. 7A illustrates a small amount of waste toner 181 that is removed from the photosensitive body 115 collects on the cleaning blade 182. When the predetermined amount of the waste toner 181 collects on the cleaning blade 182 as illustrated in FIG. 7B, the waste toner 181 is transported toward the storing portion 186 along the surface 183 as illustrated in FIG. 7C. The waste toner 181 is then stored in the storing portion 186.

The fixing unit 130 fixes the toner image to the paper P by applying heat and pressure to the toner image transferred to the paper P. The uncurling portion 134 flattens the paper P, which is curled while passing through the fixing unit 130. The paper P that passes through the uncurling portion 134 is then discharged out of the image forming apparatus 100 by the paper discharging roller 135 and is laid on the printed paper cassette 102.

With the development of new image forming technology, a longer lifespan, a high speed, and smaller developing units and image forming apparatuses have become available. However, the smaller developing units are relatively more likely to be deformed by external impact.

In the cleaning apparatus 105 and the image forming apparatus 100 including the same according to various embodiments of the present general inventive concept, unlike the conventional image forming apparatus and cleaning apparatus, the developing unit 110 as well as a portion of the photosensitive body 115 can be protected from external impact by the housing 190 of the cleaning apparatus 105. In addition, the waste toner 181 removed from the photosensitive body 115 can be transported to the waste toner reservoir unit 180 without an additional transporting device.

As described above, in a cleaning apparatus and an image forming apparatus including the same according to the various embodiments of the present general inventive concept, a waste toner reservoir unit is installed above a photosensitive body and a developing unit, thereby improving a space utilization efficiency and protecting the photosensitive body and the developing unit from deformation by external impact. When a bracket of the waste toner reservoir unit is processed by drawing and is used to store waste toner, the durability of the bracket is reinforced. In addition, the cleaning apparatus according to the various embodiments of the present general inventive concept does not require an additional waste toner transporting device, is structurally simple, and can be manufactured at low costs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A cleaning apparatus, usable in an image apparatus having a photosensitive body, the cleaning apparatus comprising:

a waste toner reservoir; and a cleaning blade installed above the photosensitive body to contact a circumference thereof, and to remove waste toner remaining on the photosensitive body, wherein a rotation of the photosensitive body pushes the removed waste toner along a surface of the cleaning blade and into the waster toner reservoir.

2. The cleaning apparatus of claim 1, where the cleaning blade angles upward at a predetermined angle between about 20° and 50° with respect to a horizontal plane of a contact point of the cleaning blade and the photosensitive body.

3. The cleaning apparatus of claim 2, where the cleaning blade angle is between 30° and 35°.

4. The cleaning apparatus of claim 1, further comprising:

an overflow blocking member to contact the circumference of the photosensitive body at a point prior to a contact point of the cleaning blade and the photosensitive body, with respect to a rotation direction of the photosensitive body, to prevent an overflow of the waste toner removed by the cleaning blade toward the photosensitive body.

5. A cleaning apparatus, comprising:

a developing unit to supply toner to an electrostatic latent image formed on a photosensitive body;

a cleaning blade installed above the photosensitive body and the developing unit to contact a circumference of the photosensitive body along a lengthwise direction thereof with a predetermined force, to remove waste toner remaining on the photosensitive body, and having a surface along which the removed waste toner is transported; and a waste toner reservoir unit to store the waste toner transported along the surface after being removed by the cleaning blade, wherein the surface slopes upward at a predetermined angle with respect to a horizontal plane and the waste toner reservoir unit comprises a bracket having a front side to which the cleaning blade is fixed and having a rear side connected to a storing portion of the waste toner reservoir unit to receive the waste toner.

6. The cleaning apparatus of claim 5, wherein the surface of the cleaning blade slopes at an angle between 30 and 35°.

7. The cleaning apparatus of claim 6, wherein the surface of the cleaning blade slopes at angle of about 35°.

8. The cleaning apparatus of claim 6, wherein the waste toner reservoir unit further comprises:

a housing installed above the bracket and combined with the bracket to prevent overflow of the waste toner from the bracket and the housing.

9. The cleaning apparatus of claim 8, wherein the housing comprises a waste toner overflow blocking member extending from a front edge thereof and having an end which contacts the circumference of the photosensitive body with a predetermined force to prevent overflow of the waste toner removed by the cleaning blade toward the photosensitive body.

10. The cleaning apparatus of claim 9, wherein the waste toner overflow blocking member comprises a sealing film made of urethane.

11. The cleaning apparatus of claim 8, wherein the bracket is manufactured using a drawing machining process and protects the photosensitive body and the developing unit from external impact.

12. The cleaning apparatus of claim 11, wherein the bracket comprises a metallic plate.

13. The cleaning apparatus of claim 11, wherein the housing comprises a waste toner overflow blocking member extending from a front edge thereof and having an end which contacts the circumference of the photosensitive body with a predetermined force to prevent overflow of the waste toner removed by the cleaning blade toward the photosensitive body.

14. A cleaning apparatus, comprising:

a body;

a waste toner storing portion formed in a bottom side of the body to store waste toner;

a cleaning blade connected to the bottom side of the body adjacent to the waste toner storing portion to contact a photosensitive body and to remove the waste toner therefrom, and being disposed at a predetermined upward angle such that the waste toner is transported along an upper surface of the cleaning blade along the body to the waste toner storing portion; and a bracket to connect the cleaning blade and the waste toner storing portion such that the bracket and the waste toner storing portion of the housing are disposed above the photosensitive body and a developing unit, and the bracket and the body protects the photosensitive body and the developing unit.

15. The apparatus of claim 14, wherein the bracket is integrally formed with the waste toner storing portion and comprises a drawn metallic plate.

16. The apparatus of claim 14, further comprising:

the developing unit disposed beneath the body of the cleaning apparatus and including:

the photosensitive body disposed beneath the cleaning blade and the bracket;

a developing roller disposed adjacent to the photosensitive body beneath the bracket; and a developing unit housing disposed beneath the waste toner storing portion including a toner storing portion to store toner and provide the stored toner to the developing roller.

17. The apparatus of claim 14, wherein the upper surface of the cleaning blade comprises a waste toner carrying surface along which the waste toner is passed to the waste toner storing portion by rotation of the photosensitive body.

18. The apparatus of claim 17, wherein the waste toner carrying surface is disposed at an angle of between 30 and 35 degrees with respect to a horizontal plane.

19. An image forming apparatus, comprising:

a photosensitive body to have an electrostatic latent image formed thereon; and a cleaning apparatus, comprising:

a developing unit to supply toner to the electrostatic latent image formed on the photosensitive body, a cleaning blade installed above the photosensitive body and the developing unit to contact a circumference of the photosensitive body along a lengthwise direction of the photosensitive body with a predetermined force, to remove waste toner remaining on the photosensitive body, and having a surface along which the removed waste toner is transported, and a waste toner reservoir unit to store the waste toner transported along the surface after being removed by the cleaning blade, wherein the surface slopes upward at a predetermined angle with respect to a horizontal plane and the waste toner reservoir unit comprises a bracket having a front side to which the cleaning blade is fixed and having a rear side connected to a storing portion of the waste toner reservoir unit to receive the waste toner.

20. The image forming apparatus of claim 19, wherein the surface of the cleaning blade slopes at an angle between 30 and 35°.

21. The image forming apparatus of claim 20, wherein the waste toner reservoir unit further comprises:

a housing installed above the bracket and combined with the bracket to prevent overflow of the waste toner from the bracket and the housing of the waste toner reservoir unit.

22. The image forming apparatus of claim 21, wherein the housing comprises a waste toner overflow blocking member extending from a front edge thereof and having an end which contacts the circumference of the photosensitive body with a predetermined force to prevent overflow of the waste toner removed by the cleaning blade toward the photosensitive body.

23. The image forming apparatus of claim 22, wherein the bracket is manufactured using a drawing machining process and protects the photosensitive body and the developing unit from external impact.

* * * * *